United States Patent [19]

Maggio

[11] Patent Number: 4,979,242

[45] Date of Patent: Dec. 25, 1990

[54] COLLAPSIBLE ROOM SHELTER

[76] Inventor: John J. Maggio, 981 W. Latimer Ave., Campbell, Calif. 95008

[21] Appl. No.: 322,677

[22] Filed: Mar. 13, 1989

[51] Int. Cl.[5] ..... A47K 11/02; A47K 3/022

[52] U.S. Cl. ..... 4/449; 4/459; 4/460; 4/661; 4/599; 135/106; 135/901; 135/902; 135/88; 215/1 C

[58] Field of Search ..... 4/484, 476, 479, 480, 4/483, 485, 449, 450, 458, 459, 460, 600, 599; 215/1 C; 135/901, 902, 106, 88; 52/71

[56] References Cited

U.S. PATENT DOCUMENTS

| | | | |
|---|---|---|---|
| 1,663,966 | 3/1928 | Ament et al. | 4/484 |
| 1,990,804 | 2/1935 | Watson | 135/902 |
| 2,519,430 | 8/1950 | Brown | 135/106 |
| 3,067,434 | 12/1962 | Neal et al. | 4/599 |
| 3,381,315 | 5/1968 | Glassberg | 4/484 |
| 3,474,844 | 10/1969 | Lindstrom et al. | 215/1 C |
| 3,629,875 | 12/1971 | Dow | 4/599 |
| 3,646,618 | 3/1972 | Johnson | 4/599 |
| 3,772,712 | 11/1973 | Renn et al. | 4/484 |
| 3,956,778 | 5/1976 | Tanaka | 4/484 X |
| 4,224,754 | 9/1980 | Derryberry | 135/901 |
| 4,492,313 | 1/1985 | Touzani | 215/1 C |
| 4,736,762 | 4/1988 | Wayman | 135/106 |
| 4,773,458 | 9/1988 | Touzani | 215/1 C |
| 4,775,564 | 10/1988 | Shriver et al. | 215/1 C X |
| 4,825,578 | 5/1989 | Robinson | 135/901 X |
| 4,871,900 | 10/1989 | Hickman | 4/600 X |
| 4,909,268 | 3/1990 | Maggio | 135/88 |

FOREIGN PATENT DOCUMENTS

| | | | |
|---|---|---|---|
| 992009 | 7/1976 | Canada | 215/1 C |
| 264553 | 1/1950 | Switzerland | 4/484 |
| 508287 | 6/1939 | United Kingdom | 135/902 |
| 527558 | 10/1940 | United Kingdom | 4/600 |

*Primary Examiner*—Henry K. Artis

[57] ABSTRACT

A collapsible portable shelter or changing room comprising a body of circular bellows like configuration capable of manufacture on current plastic mold equipment with current plastic materials. The bellows like walls overlap vertically and integrally down the side around a large aperture in a spring-like manner from tension on the rib folds by manual downward pressure. The accordion-like wall, when fully collapsed, substantially fits within an optional carry case fastened to the shelter floor. The structure is raised for use from a collapsed into an extended form by manual release of fasteners, causing the bellows wall to spring upward, without assistance, providing a large interior volume sufficient to enclose a person for use as a toilet shelter or changing room.

4 Claims, 3 Drawing Sheets

COLLAPSIBLE ROOM SHELTER

REFERENCE TO RELATED APPLICATION

This application is a continuation-in-part of co-pending application Ser. No. 07/270,970, filed Nov. 14, 1988, now U.S. Pat. No. 4,909,268.

BACKGROUND OF THE INVENTION

The field of this invention pertains to portable building structures and, in particular, to collapsible shelters for use as changing rooms and toilet enclosures of the type commonly seen at beaches, special events, parks, construction sites, and also those of modular or foldable design as cited below.

A collapsible portable shelter can be used for privacy aboard small watercraft, at campsites and other public places where conventional portable toilet shelters are impractical due to their large size, weight, or hardware components necessary to assemble into a self supporting structure, making them inconveniently, unsuitable and impractical aboard small boats, campers and similar recreational vehicles and vessels due to a lack of space.

Examples of present portable toilet and changing structures are disclosed in U.S. Pat. Nos: 4,493,118 Braxton, 4,305,164 Sargent, 4,726,155 Nahamias, 4,640,061 Trumley, 4,539,721 Moore, 4,163,294 Patterson, 4,065,885 Blick, 4,035,964 Robinson, 3,526,066 Hagar, 3,940,806 Mustee, 1,917,629 Anderson, however, none of the above citations disclose a collapsible or hand carried feature as described in the present invention.

Other examples of portable shelters fall into the classification of hunting blinds, including U.S. Pat. Nos. 3,513,605 Smith, 4,123,869 Witt, 4,224,754 Derryberry, 4,682,436 Ritson, 4,825,578 Robinson, 4,761,908 Hayes, 4,833,813 McLemore.

Articles of bellows like side wall configurations are described in U.S. Pat. Nos: 4,492,313 Touzani, 2,780,378 Romano, 3,474,844 Lindstrom, 4,044,836 Martin, 3,956,778 Tanaka, 4,773,458 Touzani, 4,775,564 Shriver, 992,009 Miller and Switzerlnd Pat. No. 264,553 Schaufelberger.

No previous privacy shelter is as portable, versatile and convenient in use, particularly on watercraft, land vehicles or at public places as is the new invention described herein.

SUMMARY OF THE INVENTION

The present invention comprises a new utility in the field of portable toilets and privacy enclosures to provide a collapsible free-standing and portable enclosure carryable by hand. The purpose of the collapsible enclosure is to provide privacy and to eliminate the problem of having a fixed or cumbersome, bulky enclosure where space is otherwise not practical for such a unit. Prior portable toilet structures were unable to meet this need.

The enclosure of the invention provides a circular tube with side walls shaped in the manner of bellows. The bellows are formed to fold as the enclosure is collapsed, causing tension on the inner and outer rib seams or folds as the enclosure is depressed, thus causing a spring like occurence as the enclosure walls are forced to remain in a compressed-together position.

A base case, or cup, is fitted to the bottom of the enclosure. It is slightly wider than the bellows and its purpose is to reinforce the bottom of the enclosure and to provide a case for the enclosure to fold into. The case also provides a convenient handle which is attached to the case wall for ease in carrying and transporting the unit.

A cover is used to seal the aperture and allow the invention, when not in use as an enclosure, to be optionally used as seating for boat passengers.

The invention can to servce on board small boats as a simple, inexpensive, lightweight, portable (or it may be built into a bow or deck), attractive, shadow-proof, durable, freestanding, collapsible room comprised of a circular shell which can be expanded for use and collapsed for space saving. To use the enclosure, a person steps onto the floor in the center of the aperture, unlatches the fasteners, and the bellows-like walls automatically spring upward, forming a solid enclosure around the user. When the unit reaches a fully extended position, it is held up in place by tension from the rib seams. After use, the invention is manually depressed and the entire unit is reduced to a compact form. The use area is restored and all preceeding loss of space no longer exists.

The principal object of the invention is to create a portable, collapsible room. No prior art device serve the purposes of the invention.

DESCRIPTION OF THE LID

Figure 1:
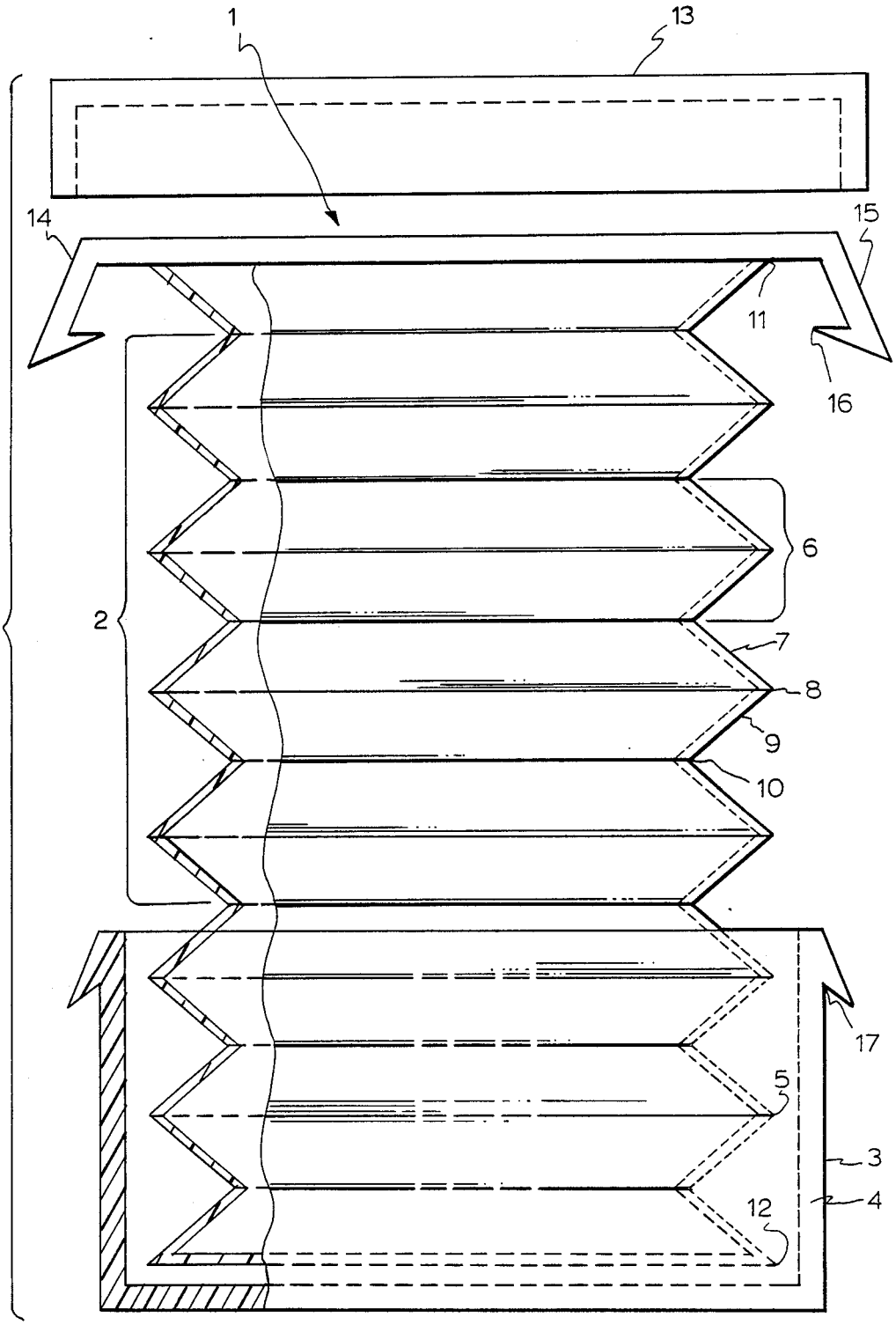
FIG. 1 is a side elevation view, partially in cross-section of the collapsible enclosure of the invention in an extended position with a base case attached and showing a lid or cap.

FIG. 1 illustrates the enclosure, generally denoted by 1, showing a generally cylinder shaped object with bellows like side walls 2 and a separate bottom base or case 3 affixed to the base of the enclosure 1. The case 3 side wall 4 is slightly wider than the cylinder to allow the bellows like side wall 2 of the enclosure 1 to fit within the case 3 when compressed 5. The bellows 2 extend to the bottom of the enclosure and the case side wall extends to the top of the enclosoure when collapsed. The enclosure expands and collapses vertically. Each bellow here indicated by 6 extends down and outward 7 to a fold 8. After the fold 8, the same rib section continues to extend down and inward 9 to the next fold 10. The entire enclosure wall is comprised of a series of overlapping folds 2 aligned and parallel between the top ring or rib 11 and the base at the floor 12. Each consecutive fold 8 and 10 is at an alternate angle to the center.

Each bellow rib 6 comprises a downwardly and outwardly extending portion 7 with all similar portions 7 being at an equal angle to the axis of the enclosure 1. In this figure, a total of seven bellows (including top and bottom half-bellows) are shown with however, in actual practice a very large number of bellows would be required to extend to the full height of the enclosure. Thus, the bellows are shown greatly enlarged in proportion to the enclosure in which the bellows are incorporated.

A hook 16 at the tip of a latch stem 15 attaches to a groove catch 17 at the top of the case when the enclosure is to be closed, securing the enclosure in a compressed condition. A lid 13 fits over the perimeter of the case 3 and an enclosure latch base 14 (see also FIG. 3).

Figure 2:
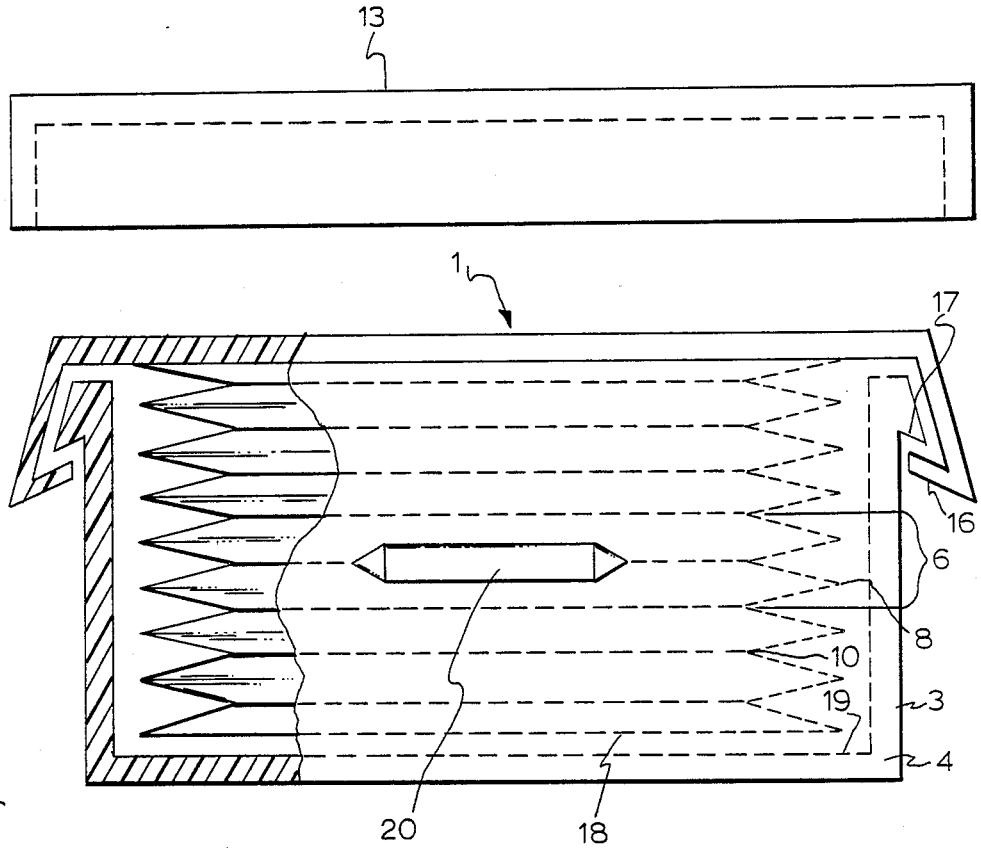
FIG. 2 is a side elevation view, partially in cross-section of the collapsible enclosure in a substantially collapsed position with the base case attached, and showing the lid.

In FIG. 2 the enclosure 1 is illustrated collapsed. As shown, the individual bellows 6 are collapsed or folded over in a uniform manner. In this figure, as in FIG. 1, the size of each bellow in proportion to the size of the enclosure is shown greatly exaggerated.

In actual practice the increase in diameter of the enclosure 1 attributed to the bellows 6 is so limited as not to substantially increase the diameter of the enclosure with the case 3 attached. The interior diameter of space between the inside case wall and outside bellows seams 8 need only be sufficient to permit the bellows to fold and fit inside the case 3. Once completely folded down into the case and fasteners 16 and 17 are set in a latched position, the bellows will not expand, despite failure to replace the case lid 13 on the case, until the fasteners are released.

The case bottm 19 is adhesively affixed to the bottom 18 of the enclosure 19. It is envisioned that in a vast majority of instances the plastic utilized for the enclosures will be a very strong and flexible plastic, such as polyethylene, and that a stronger and sturdier plastic be used to form the base case 3, with a sufficient wall thickness 4 to offer strength and durability. This should also apply to the case lid 13.

To assist in the folding and collapsing of bellows or folds manufactured from stretched plastics, the tooling of rib sections in the shape of horizontal zig-zags along the entire length of the mold are formed to create the folds 8 and 10. The mold is tooled in the size and shape of the enclosure in a fully extended position Page 5, Line 8 after "position" insert, so that the molded enclosure tends to remain in the extended position. The plastic is then injected and, through a blow mold or rotational mold process, the plastic is stretched or formed to the proper wall thickness. During this process the formation of ribs are created along the side walls at the tip of each bellow, forming circular fold rings 6 and 10 down the enclosure wall. In the process of forming the enclosure side wall the combination of the type of plastic used and the thickness at each outer rib seam (6) adds significantly to the tension strength of the enclosure side wall folds 8 and 10, to give each rib section (6) a spring tension when depressed. After removal from the mold, the bottom 18 of the enclosure is adhesively affixed to the base 19 of the shell case.

Fully collapsed into the case, the enclosure is compact, portable and easily stored. A handle 20 is affixed to the outer case wall 4.

Figure 3:
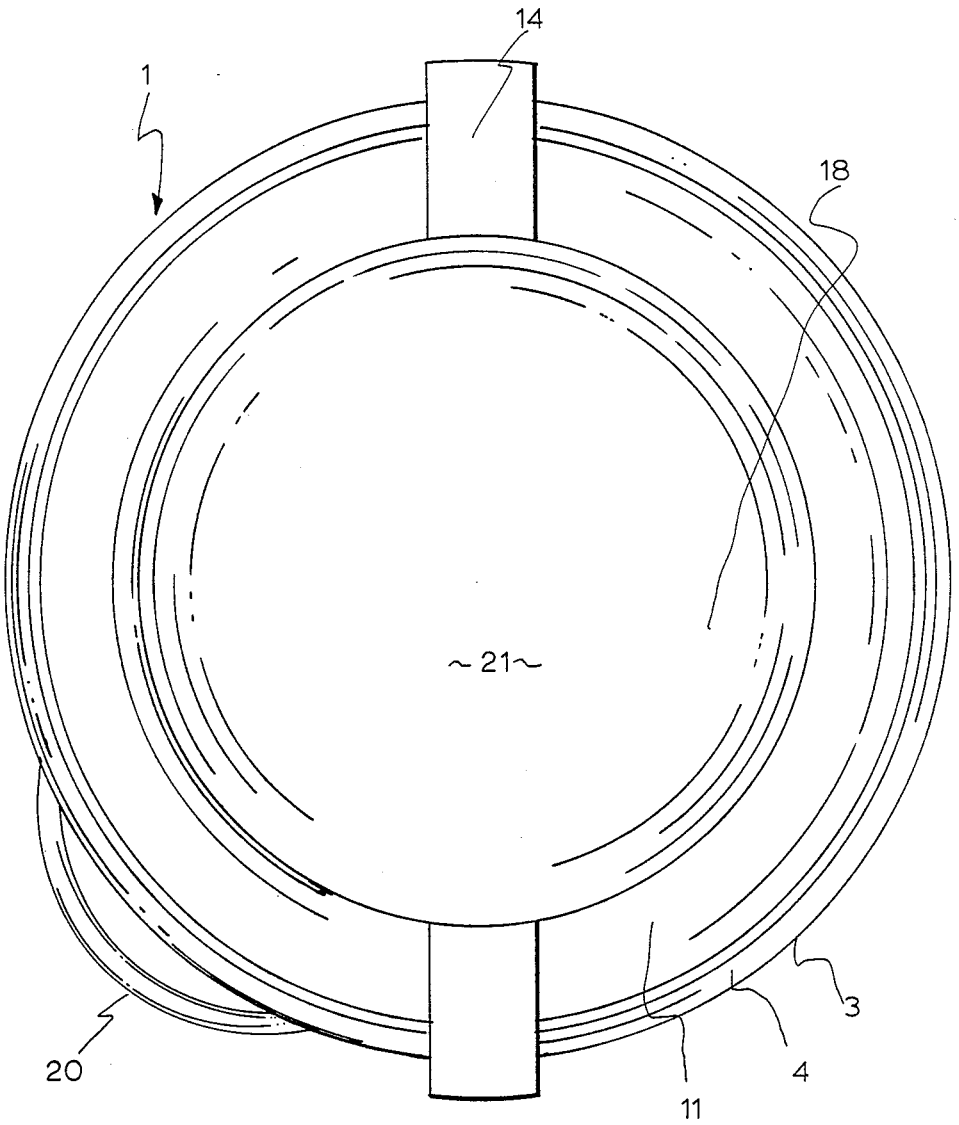
FIG. 3 is a top view of the collapsible enclosure, with-out the lid.

In FIG. 3 the invention is viewed directly from the top. The enclosure body, case body 3 and lid 13 are not exhibited. The drawing the shows case handle 20 affixed to the exterior case side wall 3. The enclosure floor 18 is seen through a large aperture 21 comprising a major volume in the enclosure center. The latches 16, of which the bases 14 are shown, connected the top of the enclosure to the top of the case, holding the bellows secured in a collapsed position.

I claim:

1. A collapsible shelter useful as a toilet, shower or changing shelter, comprising, a base, a generally cylindrical bellows-like enclosure secured to the base and comprised of a multitude of ribs arranged in accordion-like fashion and connected together by flexible folds, such that the enclosure may be extended to an open, upwardly extending position with the ribs outstretched or compressed to a closed, collapsed position with the ribs closely stacked together, the bellows-like enclosure with the ribs and the flexible folds being integrally formed of plastic material, the plastic bellows-like enclosure having a normal position of upward extension such that the enclosure is biased in spring-like fashion toward the open, upwardly extending position and such that when not restrained the enclosure will automatically spring to the upwardly extending position, the bellows-like enclosure having sufficient inside dimension to accomodate a person in the enclosure, latching means secured to the base and to the bellows-like enclosure for holding the bellows-like enclosure in the closed, collapsed position when it has been compressed to such position, and the base including a floor and a cylindrical side wall of larger diameter than the bellows-like enclosure, extending up from the floor, for encasing the bellows-like enclosure when in the closed, collapsed position.

2. The collapsible shelter of claim 1, wherein the bellows-like enclosure includes a top ring at its upper end, and with the latching means comprising at least two barb-like latch members depending downwardly from the top ring and a pair of cooperating latch receiving means connected to the base, in position to be engaged by the barb-like latch members when the bellows-like enclosure is pushed and compressed to the closed, collapsed position, the barb-like latch members being flexible so as to permit manual pulling of the latch members to release them from the latch receiving means when the collapsible shelter is to be opened and extended.

3. The collapsible shelter of claim 2, further including closure lid means for engaging over the closed, collapsed shelter and over the latching means.

4. The collapsible shelter of claim 1, wherein the cylindrical side wall has secured to its outside surface a handle for manual engagement by a user, for carrying the collapsed, closed shelter.

* * * * *